US006711374B2

(12) United States Patent
Funayama et al.

(10) Patent No.: US 6,711,374 B2
(45) Date of Patent: Mar. 23, 2004

(54) IMAGE APPARATUS WITH DEVELOPING CARTRIDGE HAVING TWO ACCOMMODATING PORTIONS

(75) Inventors: Naotaka Funayama, Tenri (JP); Jun Yamaguchi, Ikoma (JP); Yoshiaki Sanada, Ikoma (JP); Tsutomu Nagata, Hirakata (JP)

(73) Assignee: Sharp Kabushiki Kaisha, Osaka (JP)

( * ) Notice: Subject to any disclaimer, the term of this patent is extended or adjusted under 35 U.S.C. 154(b) by 61 days.

(21) Appl. No.: 10/075,453

(22) Filed: Feb. 15, 2002

(65) Prior Publication Data

US 2002/0154914 A1 Oct. 24, 2002

(30) Foreign Application Priority Data

Feb. 16, 2001 (JP) ..... P2001-039881

(51) Int. Cl.[7] ..... G03G 15/08; G03G 21/00
(52) U.S. Cl. ..... 399/359; 399/120
(58) Field of Search ..... 399/99, 120, 359

(56) References Cited

U.S. PATENT DOCUMENTS 5,200,787 A * 4/1993 Nishiguchi ..... 399/359
5,289,241 A 2/1994 Sugiyama et al. ..... 399/120
5,493,382 A * 2/1996 Takagaki et al. ..... 399/359
6,115,574 A * 9/2000 Mikuriya ..... 399/359 X
6,167,227 A * 12/2000 Fujita et al. ..... 399/359 X
6,226,490 B1 * 5/2001 Fujita et al. ..... 399/359

FOREIGN PATENT DOCUMENTS

| | | |
|---|---|---|
| JP | 4-237079 | 8/1992 |
| JP | 5341697 | * 12/1993 |
| JP | 8-44179 | 2/1996 |

* cited by examiner

*Primary Examiner*—Fred L Braun
(74) *Attorney, Agent, or Firm*—Birch, Stewart, Kolasch & Birch, LLP

(57) ABSTRACT

An image apparatus includes a cartridge with two separate accommodating portions. The first accommodating portion for accommodating unused developer and is formed in a housing. A second accommodating portion for accommodating transfer residual developer is arranged adjacent to the first accommodating portion. A conveying member extending over the first and second accommodating portions, when an amount of transfer residual developer to be stored in the second accommodating portion exceeds a predetermined level, conveys the transfer residual developer from the second accommodating portion to the first accommodating portion. Each one of the accommodating portions includes an agitator.

18 Claims, 6 Drawing Sheets

IMAGE APPARATUS WITH DEVELOPING CARTRIDGE HAVING TWO ACCOMMODATING PORTIONS

BACKGROUND OF THE INVENTION

1. Field of the Invention

The present invention relates to a developing cartridge for use in an image forming apparatus such as a copying machine, a facsimile apparatus, or a printer.

2. Description of the Related Art

As a toner cartridge for use in an image forming apparatus such as a copying machine, a facsimile apparatus, or a printer, there has conventionally been proposed a toner cartridge comprising: a toner replenishing port for supplying unused toner to a developing apparatus; an unused toner accommodating portion communicating with the toner replenishing port; a collecting port for collecting waste toner, i.e. left-over toner collected by a cleaner of an image forming apparatus after image transfer process; a waste toner accommodating portion for receiving waste toner, which communicates with the collecting port; and a partitioning wall for parting the unused toner accommodating portion from the waste toner accommodating portion, wherein the unused toner accommodating portion and the waste toner accommodating portion are formed integrally with each other.

However, such a conventional toner cartridge as described above has the following disadvantage. When an amount of waste toner to be collected by the cleaner of the image forming apparatus exceeds the capacity of the waste toner accommodating portion due to occurrence of unexpected usage and environmental conditions, the waste toner accommodating portion is filled to capacity and is thus no longer capable of receiving waste toner.

To solve such a problem, Japanese Unexamined Patent Publication JP-A 4-237079 (1992) discloses a technique embodied as an image forming unit in which an unused toner accommodating portion and a waste toner accommodating portion are formed integrally with each other. In this construction, even if the amount of the collected waste toner exceeds the capacity of the waste toner accommodating portion, the waste toner accommodating portion is protected against damage without the waste toner accommodating portion being increased in size more than necessary. That is, in the partitioning wall located between the unused toner accommodating portion and the waste toner accommodating portion is provided an opening portion having a shutter which opens under the pressure of waste toner to be accommodated in the waste toner accommodating portion. This arrangement causes waste toner in excess of the capacity of the waste toner accommodating portion to flow into the unused toner accommodating portion.

Moreover, Japanese Unexamined Patent Publication JP-R 8-44179 (1996) proposes a toner cartridge which allows effective use of unused toner and effective use of a space of a waste toner accommodating portion. This toner cartridge has such a structure that an unused toner accommodating portion and a waste toner accommodating portion are formed integrally with each other, and is provided with a pair of toner conveying members formed so as to penetrate through a partitioning wall for parting the unused toner accommodating portion from the waste toner accommodating portion.

By the rotation of the toner conveying member, within the unused toner accommodating portion, unused toner is conveyed toward a replenishing port so as to drop into a developing apparatus. This makes possible effective use of unused toner. On the other hand, within the waste toner accommodating portion, waste toner collected from a collecting port formed in the waste toner accommodating portion is conveyed toward the partitioning wall, located away from the immediately below of the collecting port, and is then stored. This makes possible effective use of a space of the waste toner accommodating portion.

However, these prior art techniques have the following disadvantages. The toner cartridge disclosed in JP-A 4-237079 is so designed that waste toner in excess of the capacity of the waste toner accommodating portion is dropped in a free-fall fashion into the unused toner accommodating portion. In this publication, the whereabouts of the opening portion for allowing waste toner to flow into the unused toner accommodating portion is merely described as a position as far away from a developing roller, which is disposed within the developing apparatus, as possible, and no mention is made as to a specific opening portion formation position on the basis of the amount of the waste toner to be produced. Furthermore, in the toner cartridge, the opening/closing action of the shutter disposed in the opening portion is dependent solely upon pressure from waste toner stored in the waste toner accommodating portion. Therefore, in a case where produced waste toner is unexpectedly increased in quantity due to the influence of the usage and environmental conditions, it is impossible to convey the waste toner to the unused toner accommodating portion in accordance with the amount of the waste toner produced, resulting in failure of proper control of the amount of the waste toner stored in the waste toner accommodating portion. That is, it is impossible to control an amount of waste toner to be conveyed from the waste toner accommodating portion to the unused toner accommodating portion.

On the other hand, in the toner cartridge disclosed in JP-A8-44179, the waste toner accommodating portion and the unused toner accommodating portion are formed integrally with each other, and coaxially within each of the toner accommodating portions is disposed conveying means for dispersing toner evenly. However, this construction, though having the technical advantage in that the waste and unused toner accommodating portions have a common conveying means driving source, is not intended for moving waste toner from the waste toner accommodating portion to the unused toner accommodating portion. Therefore, in a case where waste toner is increased in quantity due to the usage condition or other factors, in order for the entire amount of the waste toner produced to be stored in the waste toner accommodating portion without causing damage to the waste toner accommodating portion, the waste toner accommodating portion needs to have an unduly large size.

SUMMARY OF THE INVENTION

An object of the invention is to provide a developing cartridge used with one-component and dual-component developer, in which developer can be fed from a transfer residual developer accommodating portion to an unused developer accommodating portion without the transfer residual developer accommodating portion being increased in size more than necessary, and an amount of developer to be moved can be controlled properly. Another object of the invention is to provide an image forming apparatus employing said developing cartridge.

The invention provides a developing cartridge comprising:

a housing including a first accommodating portion for accommodating developer yet to be used in development, and a second accommodating portion for accommodating developer having been used in development, the second accommodating portion being arranged adjacent to the first accommodating portion; and conveying means having a conveying member, for conveying, when an amount of developer to be stored in the second accommodating portion exceeds a predetermined level, the developer from the second accommodating portion to the first accommodating portion, the conveying means being so formed as to extend over the first and second accommodating portions.

According to the invention, the conveying means having a conveying member is so formed as to extend over the first and second accommodating portions. When an amount of developer to be stored in the second accommodating portion exceeds a predetermined level, the conveying means conveys the developer from the second accommodating portion to the first accommodating portion. In this arrangement, when transfer residual developer collected after image development process is increased in quantity and consequently an amount of developer to be stored in the second accommodating portion exceeds a predetermined level, the developer is conveyed from the second accommodating portion to the first accommodating portion by the conveying member. As a result, the developer stored in the second accommodating portion is decreased in quantity. This eliminates the need to make unnecessarily large the capacity of the second accommodating portion for accommodating transfer residual developer.

In the invention, it is preferable that the conveying member is provided with a conveyance amount adjusting member for adjusting a conveyance amount of developer.

According to the invention, the conveying member is provided with a conveyance amount adjusting member for adjusting a conveyance amount of developer. This allows proper control of an amount of transfer residual developer to be conveyed from the second accommodating portion to the first accommodating portion, thereby preventing transfer residual developer from being fed to the first accommodating portion in excessively large quantities. Thus, even in a case where image development is performed with use of developer mingled with transfer residual developer, degradation in developed image quality can be successfully prevented.

In the invention, it is preferable that the first accommodating portion is provided with a first agitating member for agitating developer, and the conveying member is formed integrally with the first agitating member.

According to the invention, the first accommodating portion is provided with a first agitating member for agitating developer. This allows the unused developer yet to be used in development stored in the first accommodating portion to be evenly dispersed. Moreover, the conveying member and the first agitating member, which are conventionally provided as two separate components, are formed in one piece, and thus can be driven by a single, common driving source. This helps reduce the number of the constituent components, thereby keeping the manufacturing cost at a minimum.

In the invention, it is preferable that the second accommodating portion is provided with a second agitating member for agitating developer, and the conveying member is formed integrally with the second agitating member.

According to the invention, the second accommodating portion is provided with a second agitating member for agitating developer. This allows the transfer residual developer collected in the second accommodating portion to be evenly dispersed, and thereby prevents uneven dispersion. Therefore, it never occurs that the partial buildup of the transfer residual developer collected in the second accommodating portion, which is produced as a result of uneven dispersion, becomes so large in quantity that the developer reaches the conveying member. This makes it possible to prevent occurrence of such a problem that the developer is inadvertently conveyed to the first accommodating portion, though the developer-accommodating capacity of the second accommodating portion is not exceeded.

According to the invention, the conveying member and the second agitating member, which are conventionally provided as two separate components, are formed in one piece, and thus can be driven by a single, common driving source. This helps reduce the number of the constituent components, thereby keeping the manufacturing cost at a minimum.

In the invention, it is preferable that the first accommodating portion is provided with a first agitating member for agitating developer, the second accommodating portion is provided with a second agitating member for agitating developer, and the conveying member is formed integrally with the first and second agitating members.

According to the invention, the conveying member and the first and second agitating members, which are conventionally provided as three separate components, are formed in one piece, and thus can be driven by a single, common driving source. This helps reduce the number of the constituent components, thereby keeping the manufacturing cost at a minimum.

In the invention, it is preferable that the conveying member includes:

a conveying shaft extending in a direction in which the conveying member conveys developer; and blade members provided in the conveying shaft, the blade members being separated into two sections with respect to a virtual plane including an axis of the conveying shaft, the blade members in one section and the blade members in another section being inclined at a same angle but inclined in mutually different directions, the blade members in the respective sections being spaced.

According to the invention, the blade members, which are disposed in the conveying shaft of the conveying member, are separated into two sections by the virtual plane including the axis of the conveying shaft. Therefore, a die for molding the conveying member can be made structurally simple and thus can be fabricated inexpensively. This leads to reduction in the manufacturing cost.

In the invention, it is preferable that the conveying means further includes: a storage portion constituting a communication path which provides communication between the first and second accommodating portions for storing the conveying member; and a shutter member disposed on an outer circumferential surface of the storage portion. As the conveying shaft rotates about the axis, the blade member slides with the shutter member, and the shutter member is guided by the storage portion to move in a developer conveying direction.

According to the invention, as the conveying shaft of the conveying member rotates about the axis, the blade member disposed in the conveying shaft slides with the shutter member, and thereby the shutter member is guided by the storage portion to move in the developer conveying direction. In this structure, during the time the conveying shaft remains at rest before being rotated, the shutter member covers an opening portion formed in the storage portion, and then, when the conveying shaft starts to rotate, the shutter member is moved to open the opening portion. This helps prevent the unused developer stored in the first accommodating portion from being fed to the second accommodating portion.

In the invention, it is preferable that in the shutter member is formed a projection piece protruding toward an inner part of the storage portion, the projection piece retaining the blade member during the time the conveying shaft remains at rest before being rotated, and being disengaged from the blade member when the conveying member starts to rotate.

According to the invention, by providing a projection piece for the shutter member, the conveying member is inhibited from unnecessary rotation before being initially rotated. As a result, during the transportation and handling of the developing cartridge, the conveying member is inhibited from rotation and therefore the shutter member is no longer allowed to move in the developer conveying direction. Moreover, the opening portion formed in the storage portion can be kept in a closed state, thereby preventing backflow of the developer from the first accommodating portion to the second accommodating portion.

The invention further provides an image forming apparatus comprising:

the said developing cartridge;

a photoconductive body for carrying an electrostatic latent image;

developing means for visualizing the electrostatic latent image carried on the photoconductive body with use of developer supplied from the developing cartridge;

transfer means for transferring developer deposited on the photoconductive body onto a recording paper sheet;

residual developer removing means for removing developer remaining on the photoconductor body after image transfer process; and collecting means for collecting developer removed by the residual developer removing means.

According to the invention, the image forming apparatus includes one of the said developing cartridges. Thus, miniaturization of the apparatus can be achieved without the second accommodating portion included in the developing cartridge being increased in size more than necessary. Moreover, an amount of transfer residual developer to be conveyed from the second accommodating portion to the first accommodating portion is limited to an amount exceeding a specified capacity of the second accommodating portion. Thus, even in a case where image formation is performed with use of developer mingled with transfer residual developer, degradation in the formed image quality can be successfully prevented.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
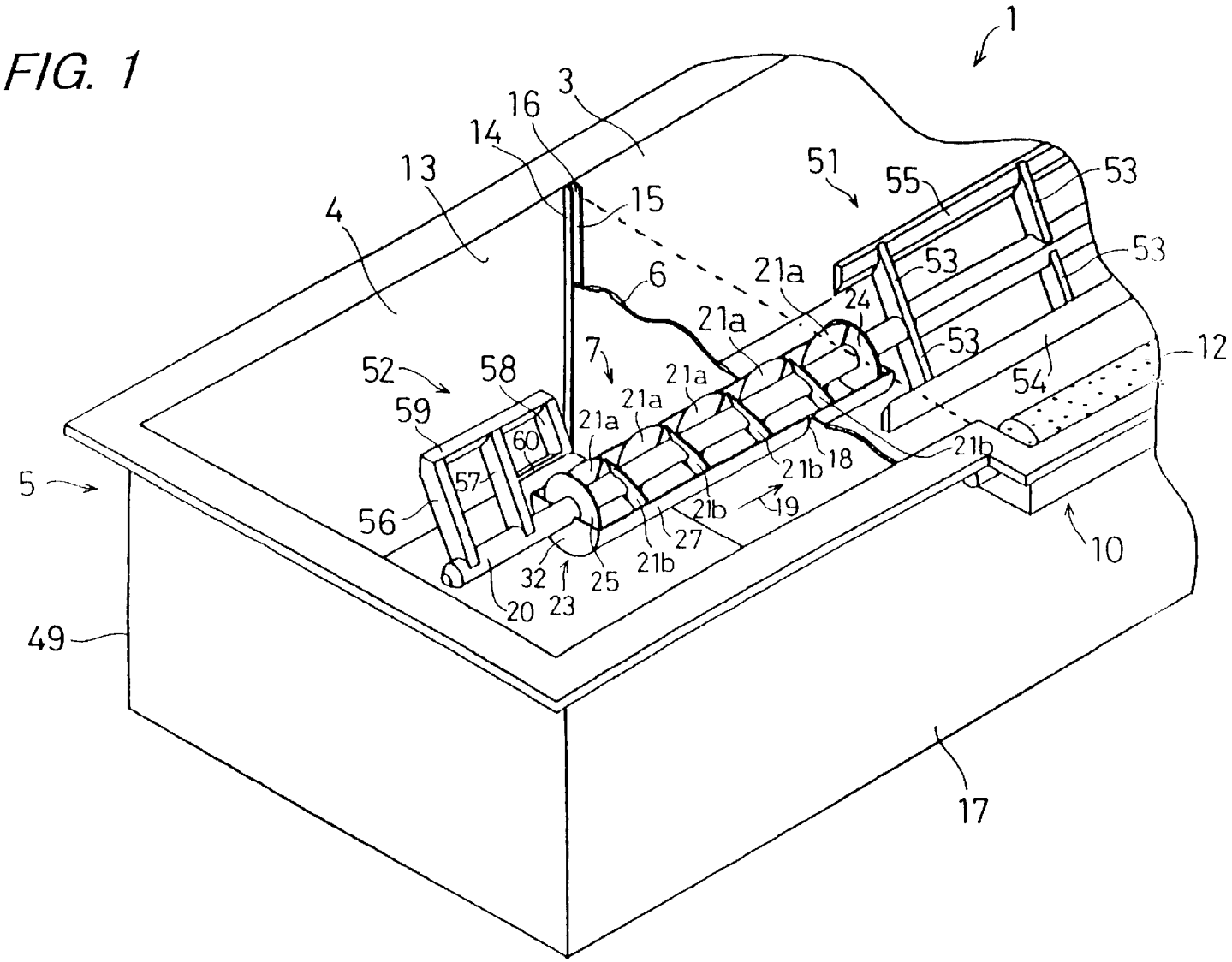
FIG. 1 is a partial perspective view showing a simplified structure of a developing cartridge of a first embodiment according to the invention.

Now referring to the drawings, preferred embodiments of the invention are described below.

Figure 2:
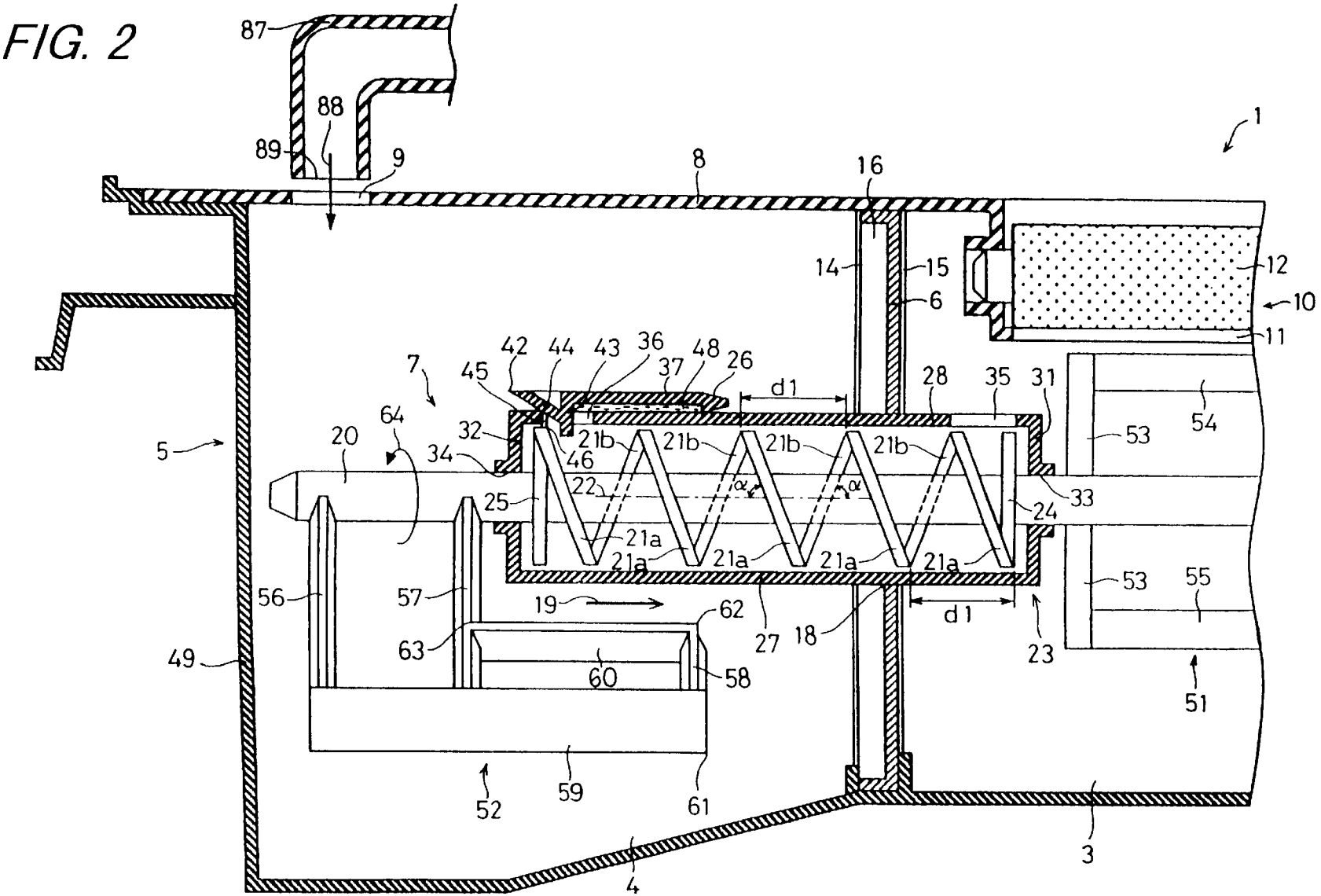
FIG. 2 is a schematic sectional view showing the simplified structure of the developing cartridge shown in FIG. 1.
Figure 3:
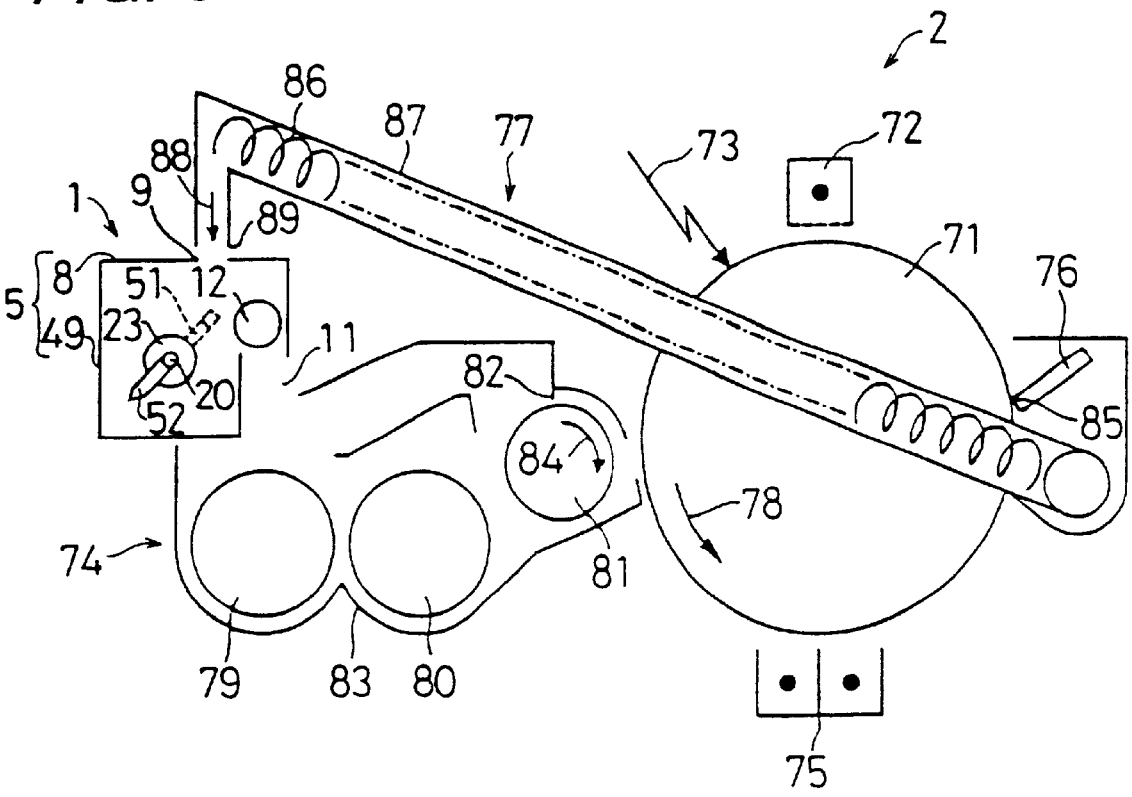
FIG. 3 is a schematic diagram showing a simplified structure of an image forming apparatus 2 in which the developing cartridge shown in FIG. 1 is incorporated.

FIG. 1 is a partial perspective view showing a simplified structure of a developing cartridge 1 of a first embodiment of the invention; FIG. 2 is a schematic sectional view showing the simplified structure of the developing cartridge 1 shown in FIG. 1; and FIG. 3 is a schematic diagram showing a simplified structure of an image forming apparatus 2 having the developing cartridge 1 shown in FIG. 1.

The developing cartridge 1 is composed of a housing 5, a partitioning member 6, and conveying means. The housing 5 includes a first accommodating portion 3 for accommodating developer yet to be used in development, and a second accommodating portion 4 arranged adjacent to the first accommodating portion 3, for receiving developer having been used in development. The partitioning member 6 serves to part the first accommodating portion 3 from the second accommodating portion 4. The conveying means is formed so as to extend over the first and second accommodating portions 3 and 4, and, when an amount of developer to be stored in the second accommodating portion 4 exceeds a predetermined level, conveys the developer from the second accommodating portion 4 to the first accommodating portion 3. The conveying means is provided with a carrying member 7.

Here, the developer in use may be either of one-component type composed solely of toner or of dual-component type composed of toner and carrier. Moreover, the term "developer having been used in development" signifies certain developer which, in the subsequently-described image forming apparatus 2, remains on a surface of a photoconductive body 71 without being transferred onto a recording paper sheet, and is thereafter removed from the surface of the photoconductive body 71 by residual developer removing means 76. Hereafter, this developer will be referred to as "transfer residual developer". On the other hand, the term "developer yet to be used in development" signifies developer which is supplied from the developing cartridge 1 to developing means 74 for development processing required to visualize an electrostatic latent image formed on the surface of the photoconductive body 71. This term signifies not only developer which has never been used in development processing, but also developer composed of a mixture of developer which has never been used in development processing and part of transfer residual developer. Hereafter, this developer will be referred to as "unused developer".

The housing 5, a hollow-body, slim container made of synthetic resin, includes a container body 49 in which the first and second accommodating portions 3 and 4 are formed, and a lid 8 for covering the first and second accommodating portions 3 and 4. The lid 8 has a collecting port 9 placed immediately above the second accommodating portion 4, for collecting transfer residual developer. Moreover, the housing 5 is arranged adjacent to the first accommodating portion 3 and includes a slim replenishing portion 10 elongated in a direction parallel to the first accommodating portion 3. Formed below the replenishing portion 10 is a replenishing port 11 extending along a longitudinal direction of the replenishing portion 10. Provided at a position facing the replenishing port 11 is a replenishing roller 12.

The partitioning member 6, formed as a flat plate made of synthetic resin, is fitted into a first groove portion 16 and a second groove portion (not shown) so as to part the first and second accommodating portions 3 and 4 from each other. The first groove portion 16 is composed of a first and a second supporting piece 14 and 15 that are continuous with an inner surface of a first wall portion 13 of the housing 5 and arranged parallel to each other at an interval in a direction perpendicular to the longitudinal direction of the container body 49. The second groove portion, which has the same structure as the first groove portion 16, is formed on an inner surface of a second wall portion 17 so as to face to face with the first groove portion 16. In the partitioning member 6 is formed a through hole 18 through which the conveying member 7 passes.

The conveying member 7 extends through the through hole 18 formed in the partitioning member 6 over the first and second accommodating portions 3 and 4. The conveying member 7 includes a conveying shaft 20 and blade members 21*a* and 21*b*. The conveying shaft 20 extends in a developer conveying direction indicated by arrow 19. The blade members 21*a* and 21*b* are spaced apart in the conveying shaft 20. The blade members 21*a* and 21*b* are separated into two sections with respect to a virtual plane including an axis 22 of the conveying shaft 20. The blade member in one section and that in another section are inclined at the same angle $\alpha$ but inclined in mutually different directions. The conveying member 7 passes through the through hole 18 formed in the partitioning member 6 to be stored in a storage portion 23 constituting a communicating path 23*a* for providing communication between the first and second accommodating portions 3 and 4.

The conveying shaft 20, formed as a cylindrical or tubular member made of metal or hard synthetic resin, extends parallely in a longitudinal direction of the housing 5. The blade member 21*a*, 21*b*, formed as a thin semicircular plate member made of synthetic resin, has a semicircular notch formed around its central portion, and is thereby attached to the conveying shaft 20. Being formed as a thin plate made of synthetic resin, the blade member 21*a*, 21*b* is elastically deformable. A plurality of blade members 21*a*, disposed on one side of the virtual plane including the axis 22 of the conveying shaft 20, are inclined at an angle $\alpha$ with respect to the axis 22 of the conveying shaft 20, and fittedly arranged in the conveying shaft 20 along the axis 22 direction with an interval d1 between them.

A plurality of blade members 21*b*, disposed on the other side of the virtual plane, are inclined at an angle $\alpha$ in a direction reverse to the direction in which the blade members 21*a* are inclined, and fittedly arranged in the conveying shaft 20 along the axis 22 direction with an interval d1 between them. At the outward ends of the blade member 21*a*, 21*b* fitted to the conveying shaft 20 in the axis 22 direction are disposed a first and a second extreme end portion 24 and 25, respectively. Each of the first and second extreme end portions 24 and 25, formed as a thin semicircular plate member made of synthetic resin, has, in its central portion, a circular hole through which the conveying shaft 20 is inserted, and is thereby attached to the conveying shaft 20. The first and second extreme end portions 24 and 25 are accommodated in a storage portion 23 together with the conveying shaft 20 and the blade members 21*a* and 21*b*.

In the conveying member 7, as described above, a plurality of blade members 21*a* and 21*b* are fitted to the conveying shaft 20 so as to constitute a simple helical structure. By providing the conveying member 7 with a simple helical structure, adequate developer-conveying capacity can be ensured. Moreover, the blade members 21*a* and 21*b* are separated into two sections by the virtual plane including the axis 22 of the conveying shaft 20. Therefore, a die for molding the conveying member 7 can be made structurally simple and thus can be fabricated inexpensively. This leads to reduction in the manufacturing cost.

Figure 4:
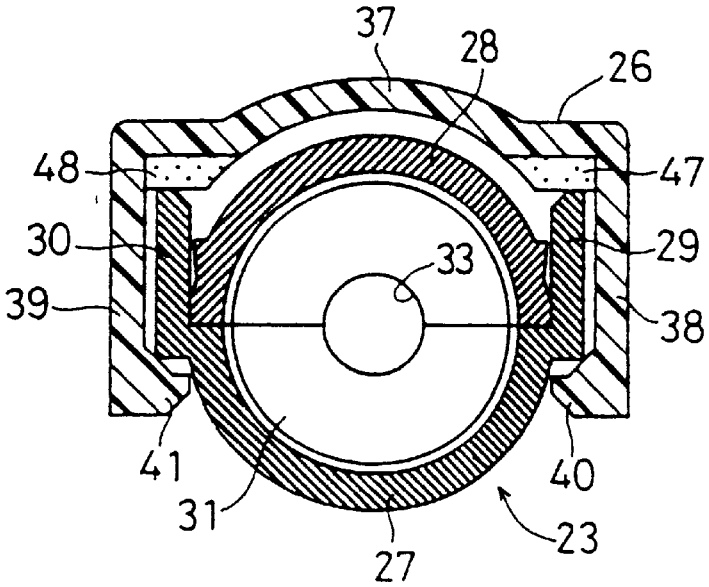
FIG. 4 is a sectional view showing simplified structures of a storage portion and a shutter member.

FIG. 4 is a sectional view of a simplified structure of the storage portion 23 and a shutter member 26. The conveying means further includes the storage portion 23 and the shutter member 26. The storage portion 23 is made of metal or synthetic resin and has a substantially cylindrical form. The storage portion 23 includes semicircular first and second path members 27 and 28 that are obtained by splitting a cylindrical component into two parts in a direction of the length thereof. On both sides of the first path member 27 are formed a first and a second guiding piece 29 and 30, respectively, that are raised tangentially with respect to a semicircle formed in a section perpendicular to the longitudinal direction of the first path member 27. The first and second guiding pieces 29 and 30 extend along the longitudinal direction. The first path member 27 has a semicircular notch formed in a central portion of each end face thereof. Similarly, the second path member 28 also has a semicircular notch formed on its end face. Consequently, when the storage portion 23 is constructed by coupling the first path member 27 to the second path member 28, by the notches, a first and a second end face 31 and 32 of the storage portion 23 are provided with a first and a second insertion hole 33 and 34, respectively, through which the conveying shaft 20 is inserted.

The storage portion 23 has, at its one end located on the side of the first accommodating portion 3, a discharge port 35 facing the lid 8 for discharging developer, and has, at its other end located on the side of the second accommodating portion 4, an inflow port 36 facing the lid 8 for admitting developer.

The storage portion 23 also has, on its outer circumferential surface, a shutter member 26 for covering the inflow port 36 formed in the storage portion 23. The shutter member 26, made of synthetic resin, extends along the longitudinal direction of the storage portion 23 and has a section of the shape of substantially inverted U, as viewed from a direction perpendicular to the longitudinal direction. The shutter member 26 includes a shutter basal portion 37 and a first and a second leg portion 38 and 39. The shutter basal portion 37 extends along the outer circumferential surface of the storage portion 23. The first and second leg portions 38 and 39 are integrally formed at both ends of the shutter basal portion 37 so as to extend substantially vertically from the shutter basal portion 37. The first and second leg portions 38 and 39 have a first and a second holding piece 40 and 41, respectively, formed at the end portions thereof. The first and second holding pieces 40 and 41 hold the first and second guiding pieces 29 and 30 formed in the first path member 27, respectively, so that the shutter member 26 is guided by the first and second guiding pieces 29 and 30 to move in the developer conveying direction indicated by arrow 19.

Formed in the vicinity of one end portion 42 of the shutter member 26 are: a protrusion 43 which is continuous with the shutter basal portion 37 and extends substantially vertically therefrom toward the inner part of the storage portion 23; and an connecting portion 44 which is continuous with the protrusion 43 and inclined from the end portion 42 toward the protrusion 43.

The connecting portion 44 has, at approximately its midpoint position between the end portion 42 of the shutter member 26 and the protrusion 43, a projecting piece 45 which extends vertically toward the inner part of the storage portion 23. The projecting piece 45 is made of synthetic resin and shaped like a rod, and its front end 46 has such a length as to retain at least one of the blade members 21*a*. When the conveying shaft 20 is driven by a non-illustrated electric motor, for example, to rotate about the axis 22 and then loaded with an external force by the blade member 21*a* fitted to the conveying shaft 20, the projecting piece 45 is subjected to breakage or bending so that the connecting portion 44 is not adversely affected.

A first and a second sealing member 47 and 48 are respectively stuck on the inner surfaces around both ends of the shutter basal portion 37. The first and second sealing members 47 and 48 are each formed as a rectangular sheet member made of a sponge-like porous elastic body, and have such a thickness as to abut against the end portions of the first and second guiding pieces 29 and 30, respectively. The first and second sealing members 47 and 48 seal a gap between the inner circumferential surface of the shutter member 26 and the outer circumferential surface of the storage portion 23, thereby preventing the unused developer stored in the communicating path 23*a* from flowing into the second accommodating portion 4. In this embodiment, ester polyurethane form is used for the first and second sealing members 47 and 48.

By arranging the shutter member 26 thus constructed at such a position as to cover the inflow port 36 formed in the storage portion 23, during the transportation and handling of the developing cartridge 1 before usage, it is possible to prevent the unused developer stored in the first accommodating portion 3 from passing through the communicating path 23*a* and further prevent the unused developer from back-flowing from the communicating path 23*a* through the inflow port 36 to the second accommodating portion 4.

The conveying shaft 20 provided in the conveying member 7 of the embodiment extends through the first and second insertion holes 33 and 34 of the communicating path 23*a* into the first and second accommodating portions 3 and 4. The conveying shaft 20 has, in its part extendedly located on the first accommodating portion 3 side, a first agitating member 51 for agitating unused developer, which is formed integrally with the conveying member 7, and also has, in its part extendedly located on the second accommodating portion 4 side, a second agitating member 52 for agitating transfer residual developer, which is formed integrally with the conveying member 7. That is, the conveying member 7 is formed integrally with the first and second agitating members 51 and 52. Hence, the conveying member 7, the first agitating member 51, and the second agitating member 52, which are conventionally provided as three separate components, are formed in one piece, and thus can be driven by a single, common driving source. This helps reduce the number of the constituent components, thereby keeping the manufacturing cost at a minimum.

The first agitating member 51 is made of metal or hard synthetic resin and formed as a ladder-like frame body. The first agitating member 51 includes a plurality of blade supporting pieces 53 and a first and a second agitating blade member 54 and 55. The blade supporting pieces 53 are substantially rectangular parallele piped in form. Between the conveying shaft 20 and the first and second agitating blade members 54 and 55, the blade supporting pieces 53 are arranged parallel to each other at predetermined intervals in the axis 22 direction within the same plane, and extend outward in the radial direction of the conveying shaft 20. The first and second agitating blade members 54 and 55 are formed as members of blade profile, and are continuous with the end portion of the blade supporting piece 53 opposite to the conveying shaft 20-side end portion thereof.

The first agitating member 51 agitates the unused developer stored in the first accommodating portion 3 so as for the unused developer to be evenly dispersed within the first accommodating portion 3. Moreover, at the time when the specified capacity of the second accommodating portion 4 is exceeded and then transfer residual developer is conveyed by the conveying member 7 from the second accommodating portion 4 to the first accommodating portion 3, the first agitating member 51 agitates the unused developer stored in the first accommodating portion 3 and the transfer residual developer so that they are evenly dispersed.

The second agitating member 52 is made of metal or hard synthetic resin and formed as a substantially L-shaped frame body. The second agitating member 52 includes: a first, a second, and a third blade supporting body 56, 57, and 58; and a third and a fourth agitating blade member 59 and 60. The first to third blade supporting bodies 56, 57, and 58 are substantially rectangular parallelepiped or flat hexagonal prism in form. Between the conveying shaft 20 and the third agitating blade member 59, the first and second blade supporting bodies 56 and 57 are arranged parallel to each other at predetermined intervals in the axis 22 direction within the same plane, and extend outward in the radial direction of the conveying shaft 20.

The third agitating blade member 59 is substantially triangular prism in form and continuous with the end portions of the first and second blade supporting bodies 56 and 57 opposite to the conveying shaft 20-side end portions thereof. The third blade supporting body 58 is made shorter in length than the first and second blade supporting bodies 56 and 57 and disposed at one end portion 61 of the third agitating blade member 59. The fourth agitating blade member 60 is formed as a flat member of substantially rectangular parallelepiped in form, and has its one end portion 62 extended to the third blade supporting body 58, and has its other end portion 63 extended to the second blade supporting body 57. The fourth agitating blade member 60 is arranged parallel to the third agitating blade member 59 within the same plane.

The second agitating member 52 agitates and disperses the transfer residual developer collected in the second accommodating portion 4. This makes uniform the buildup height of the transfer residual developer and prevents uneven dispersion. As a result, it never occurs that the partial buildup of the transfer residual developer collected in the second accommodating portion 4, which is produced as a result of uneven dispersion, becomes so large in quantity that the developer reaches the conveying member 7. This makes it possible to prevent occurrence of such a problem that the developer is inadvertently conveyed to the first accommodating portion, though the developer-accommodating capacity of the second accommodating portion 4 is not exceeded.

Next, a description will be given below as to a specified amount of the transfer residual developer collected in the second accommodating portion 4 disposed in the developing cartridge 1 of the embodiment. In most cases, the capacity of the second accommodating portion 4 is so determined that every transfer residual developer which possibly includes foreign substances or impurities, such as paper fragments, causing black points or lines leading to image degradation is fully stored in the second accommodating portion 4. That is, the transfer residual developer accommodating capacity X of the second accommodating portion 4 is defined by the following formula:

$$X=Y\times(1-K) \quad (1)$$

wherein

K represents a transfer efficiency for which developer, which has been used to visualize the electrostatic latent image carried on the surface of the photoconductive body 71 of the image forming apparatus 2, is transferred onto a recording paper sheet by a transfer device 75; and Y represents an amount of unused developer to be stored in the first accommodating portion 3 in preparation for development.

A transfer efficiency K of 85 percent or above can be obtained in 90 to 95 percent of commonly-used image forming apparatuses under usage condition. In light of this, a setting of the capacity of the second accommodating portion 4 will be described below by way of specific examples, provided that a rate at which transfer residual developer is produced is 15 percent (=1−0.85). For example, in a case where the developing cartridge 1 is in mint state and the unused developer stored in the first accommodating portion 3 is 745 g in weight, of which 20 g is left unused in development and remains at the bottom of the first accommodating portion 3. By using developer of 725 g, approximately 2500 pieces of recording paper sheets can be subjected to image recording. In this case, based on the above formula (1), an amount of transfer residual developer to be produced is given as:

$$108.75\ g=725\ g\times(1-0.85).$$

The specified transfer residual developer accommodating capacity of the second accommodating portion 4 is dependent on the arrangement of the inflow port 36 formed in the storage portion 23 extending into the second accommodating portion 4. That is, the inflow port 36 formed in the storage portion 23 is arranged at such a position as to store developer of 108.75 g at the bottom of the second accommodating portion 4. By doing so, the entire amount of the transfer residual developer produced can be stored in the second accommodating portion 4, and thus it never occurs that the transfer residual developer is conveyed to the first accommodating portion 3 to be mingled with the unused developer stored in the first accommodating portion 3. As a result, it is possible to achieve image formation without causing problems such as image defects, surface smudges, or scattering of developer due to foreign substances or impurities which are possibly contained in transfer residual developer.

However, depending upon the usage condition of the image forming apparatus, the transfer efficiency K is not always kept at 85 percent. For example, when the image forming apparatus suffers from troubles such as jamming of recording paper sheets along partway of the paper feeding path, i.e. a paper jam, the developer deposited on the surface of the photoconductive body 71 is no longer transferred onto the recording paper sheet but is collected in the second accommodating portion 4 as transfer residual developer. This may lead to occurrence of a larger than expected amount of transfer residual developer. Furthermore, depending upon variations in electrostatic characteristics of developer, types of recording paper sheets, or the usage condition of the image forming apparatus, the transfer efficiency K may possibly become less than 85 percent.

In a case where the transfer efficiency K is reduced to 65 percent due to such reasons as described above, based on the formula (1), an amount of transfer residual developer to be produced is given as:

$$253.75\ g\{=725\ g\times(1-0.65)\}.$$

That is, the transfer residual developer amount of 108.75 g calculated at the transfer efficiency K of 85% is exceeded. At this time, the conveying member 7 conveys transfer residual developer to be collected in the second accommodating portion 4 in excess of 108.75 g toward the first accommodating portion 3. The specified capacity of the second accommodating portion 4 is also dependent on the conveying capacity of the conveying member 7. Specifically, there is a possibility that transfer residual developer to be produced cannot be wholly accommodated under the condition that the limit is set to be 108.75 g corresponding to the transfer efficiency K of 85%. Accordingly, the capacity of the second accommodating portion 4 is determined in accordance with the conveying capacity of the conveying member 7.

In a case where the conveying capacity of the conveying member 7 for conveying transfer residual developer from the second accommodating portion 4 to the first accommodating portion 3 is set at 1 g/min, if the transfer efficiency K is assumed to be 65 percent, then the amount of the transfer residual developer to be produced is increased to 253.75 g. In this case, however, transfer residual developer to be stored in the second accommodating portion 4 in excess of the predetermined amount is conveyed by the conveying member 7 to the first accommodating portion 3 one after another. In light of this, by setting the volume of the second accommodating portion 4 to be 217.5 g, i.e. smaller than the amount of the transfer residual developer to be produced (253.75 g), the entire amount of transfer residual developer to be produced can be fully accommodated. On the other member 7 is set at 2 g/min and, likewise as the foregoing, the transfer efficiency K is assumed to be 65 percent, by further reducing the volume of the second accommodating portion 4 to be 172.5 g, the entire amount of transfer residual developer to be produced can be fully accommodated.

As described heretofore, in the developing cartridge 1 of the embodiment, even if an amount of transfer residual developer to be produced exceeds the specified capacity of the second accommodating portion 4, the conveying member 7 conveys the transfer residual developer from the second accommodating portion 4 to the first accommodating portion 3. This eliminates the need to make the capacity of the second accommodating portion 4 unnecessarily large.

Subsequently, a description will be given as to the working of the developing cartridge 1 constructed in the above-described manner. In the developing cartridge 1 in an unused state prior to being mounted in the image forming apparatus 2, for example, in the developing cartridge 1 during shipment from a location of manufacture to a location of use and handling, the shutter member 26, which is formed on the outer circumferential surface of the storage portion 23, is arranged at such a position as to cover the inflow port 36 of the storage portion 23. In the state in which the shutter member 26 is arranged at such a position as to cover the inflow port 36 of the storage portion 23, the projecting piece 45 formed in the connecting portion 44 of the shutter member 26 retains the end portion of one of the blade members 21*a* fitted to the conveying shaft 20, thereby preventing unnecessary rotation of the conveying member 7. With this arrangement, during the transportation and handling of the developing cartridge 1, the conveying member 7 is inhibited from rotation to move the shutter member 26, and thereby the inflow port 36 formed in the storage portion 23 is maintained in a closed state. As a result, the unused developer stored in the first accommodating portion 3 in advance is prevented from back-flowing from the communicating path 23*a* through the inflow port 36 to the second accommodating portion 4.

In a state in which the developing cartridge 1 is fitted in a predetermined position of the image forming apparatus 2 in the location of use, when the image forming apparatus 2 starts to operate, the conveying shaft 20 of the conveying member 7 also starts to rotate. This is because the driving source of the conveying member 7 is shared between the conveying member 7 and the photoconductive body 71 provided in the image forming apparatus 2. When the conveying member 7 starts to rotate, the projecting piece 45 is disengaged from its corresponding blade member 21*a*, and thereby the conveying member 7 is allowed to rotate in a direction indicated by arrow 64. The disengagement structure between the projecting piece 45 and the blade member 21*a* can be realized in the following manner. The driving source produces a torque urging the conveying shaft 20 to rotate, and thereby one blade member 21*a* fitted to the conveying shaft 20 loads the projecting piece 45 with a force that tends to push it toward the direction indicated by the arrow 64. Then, the projecting piece 45 is subjected to breakage or bending by the force exerted by the blade member 21*a*, whereby the projecting piece 45 is disengaged from the blade member 21*a*.

Figure 5:
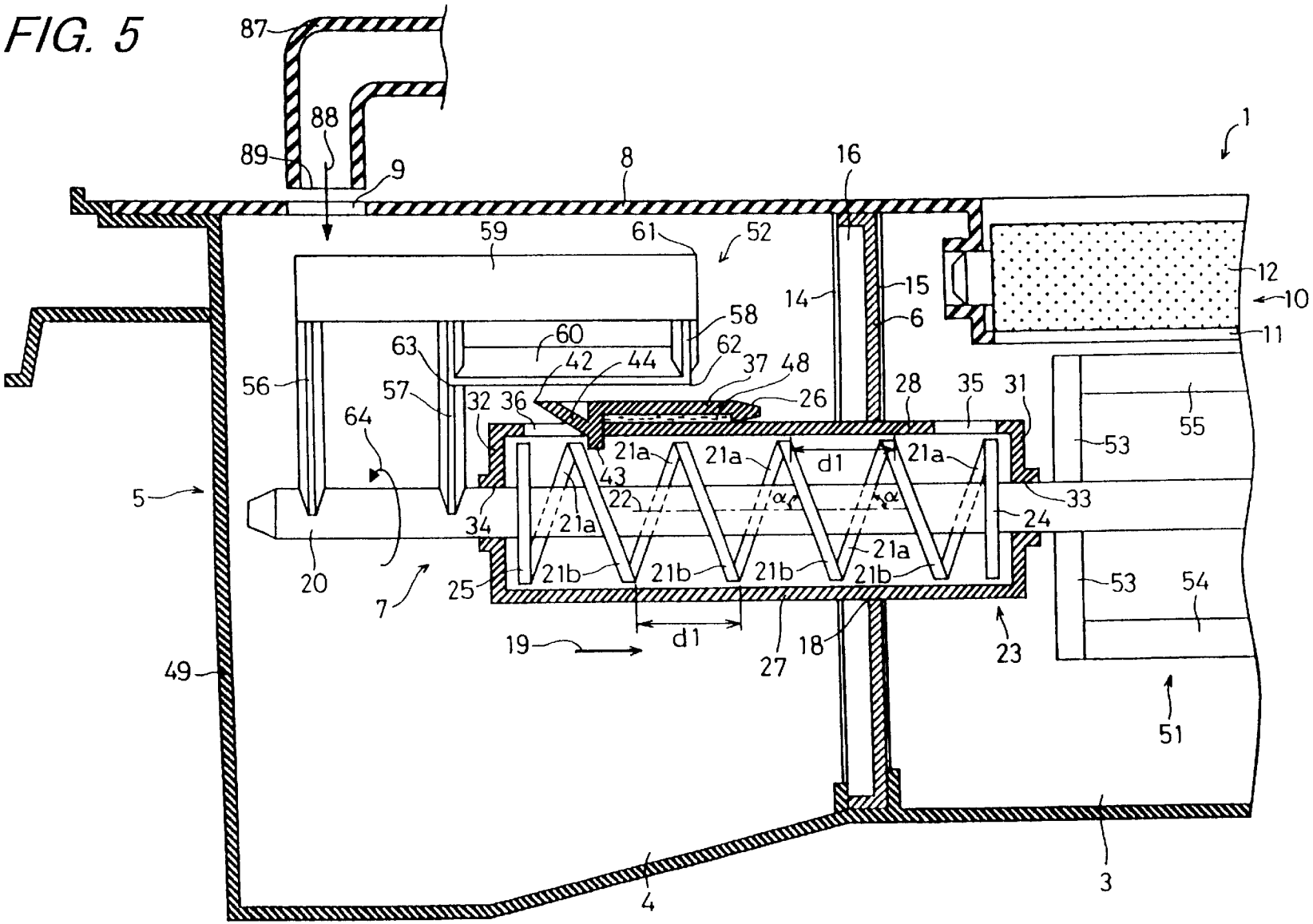
FIG. 5 is a simplified schematic sectional view showing a state in which a conveying member of the developing cartridge shown in FIG. 2 is angularly displaced by 180 degree.

FIG. 5 is a simplified schematic sectional view illustrating a state in which the conveying member 7 of the developing cartridge 1 shown in FIG. 2 is angularly displaced by 180 degree. As the conveying shaft 20 rotates in the arrow 64 direction, the blade member 21*a* slides while abutting against the protrusion 43 formed in the shutter member 26. The blade member 21*a* is fitted to the conveying shaft 20 in such a way as to be inclined at an angle $\alpha$ with respect to the axis 22. Therefore, as the blade member 21*a* slides while abutting against the protrusion 43, the shutter member 26 is driven to move in the developer conveying direction indicated by the arrow 19. By the driving force exerted by the blade member 21*a*, the shutter member 26 is guided to move in the developer conveying direction by the first and second guiding pieces 29 and 30 formed in the first path member 27 of the storage portion 23.

After the blade member 21*a* shown in FIG. 5 is brought from an unrotated state into a 180-degree angularly displaced state, the shutter member 26 moves until its protrusion 43 abuts against the first accommodating portion 3-side inner edge of the inflow port 36 formed in the storage portion 23, and thereby the inflow port 36 is opened. During the time the shutter member 26 is in such a position as to open the inflow port 36 and the conveying member 7 rotates, the blade member 21*a* rotates without abutting against the protrusion 43. Moreover, in a case where the shutter member 26 moves in a direction reverse to the developer conveying direction due to, for example, oscillation caused by the operation of the image forming apparatus 2, by the rotation of the conveying member 7, the blade member 21*a* slides while abutting against the protrusion 43 once again so as to drive the shutter member 26 to move in the developer conveying direction. This allows the inflow port 36 to be maintained in an opened state.

When an amount of transfer residual developer to be collected in the second accommodating portion 4 is equal to or less than the specified capacity of the second accommodating portion 4, the buildup height of the transfer residual developer accumulated at the bottom of the second accommodating portion 4 does not reach the inflow port 36. Thus, though the conveying member 7 is being rotated, it never occurs that the transfer residual developer is conveyed to the first accommodating portion 3.

In a case where the transfer efficiency K is reduced due to occurrence of troubles such as jamming of recording paper sheets and consequently an amount of transfer residual developer to be collected in the second accommodating portion 4 exceeds the specified capacity of the second accommodating portion 4, the buildup height of the transfer residual developer reaches the specified position of the inflow port 36 formed in the storage portion 23. As a result, the transfer residual developer flows through the inflow port 36 into the communicating path 23*a*. The inflow of the transfer residual developer into the communicating path 23*a* is conveyed, by a plurality of blade members 21*a* and 21*b* fitted to the conveying shaft 20, in the arrow 19 direction so as to reach the discharge port 35 formed in part of the storage portion 23 extending into the first accommodating portion 3. Eventually, the transfer residual developer is discharged through the discharge port 35 into the first accommodating portion 3.

In this embodiment, the first and second agitating members 51 and 52 are formed integrally with the conveying member 7. Thus, as the conveying member 7 is driven to rotate, the first and second agitating members 51 and 52 are also driven to rotate. As a result, the transfer residual developer discharged into the first accommodating portion 3 is agitated by the first agitating member 51, and is thereby evenly dispersed and simultaneously mingled with the developer stored in the first accommodating portion 3 in advance, thereby achieving homogenization of the developer. The unused developer stored in the first accommodating portion 3 is agitatedly conveyed by the first agitating member 51 to the replenishing roller 12 disposed in the replenishing portion 10, and is then supplied through the replenishing port 11 to the developing means 74 by the replenishing roller 12 for development processing.

As described above, the second agitating member 52 is formed integrally with the conveying member 7. Thus, as the conveying member 7 rotates about the axis 22, the second agitating member 52 also rotates. The transfer residual developer removed from the surface of the photoconductive body 71 by the residual developer removing means 76 is collected in the second accommodating portion 4 through the collecting port 9 formed in the lid 8 of the housing 5, and is then agitated by the second agitating member 52. This agitation treatment prevents uneven dispersion of the transfer residual developer collected in the second accommodating portion 4 immediately below the collecting port 9, and thus prevents unevenness in the buildup height. As a result, the buildup height of the transfer residual developer collected in the second accommodating portion 4 is made substantially uniform, and only the transfer residual developer in excess of the specified capacity of the second accommodating portion 4 is allowed to flow from the second accommodating portion 4 into the inflow port 36, and is then conveyed by the conveying member 7 to the first accommodating portion 3.

The image forming apparatus 2 to which the developing cartridge 1 of the embodiment is incorporated includes: the photoconductive body 71 for carrying an electrostatic latent image; a charger 72; an exposure device 73; the developing means 74 for visualizing an electrostatic latent image carried on the photoconductor body 71 with use of developer supplied from the replenishing port 11; a transfer device 75 for transferring developer deposited on the photoconductive body 71 onto a recording paper sheet; the residual developer removing means 76 for removing developer remaining on the photoconductor body 71 after image transfer process; and collecting means 77 for collecting the developer removed by the residual developer removing means 76.

The photoconductive body 71 is cylindrically shaped and has a photoconductive layer formed in the outer circumferential portion thereof. The photoconductive body 71 is rotatably supported by the image forming apparatus 2 body and is driven by a motor or the like to rotate about an axis perpendicular to a paper face on FIG. 3 in a direction indicated by arrow 78. The charger 72 is arranged opposite the photoconductive body 71 and allows the entire surface of the photoconductor body 71 to be uniformly charged. Prior to development, by the exposure device 73, the uniformly-charged surface of the photoconductive body 71 is subjected to irradiation of light in accordance with image information so that an electrostatic latent image is formed thereon.

The developing means 74 includes: a first and a second agitating roller 79 and 80; a developing roller 81; a doctor blade 82; and a development container 83. The developing roller 81 is made of aluminum and shaped like a right cylinder. Inside the developing roller 81 are arranged cylindrical or tubular permanent magnet pieces. The developing roller 81 is rotatably supported by the development container 83 for accommodating unused developer supplied from the developing cartridge 1, and is driven by a motor or the like to rotate about an axis which is parallel with respect to a plane including the axis of the photoconductive body 71 in a direction indicated by arrow 84.

The first and second agitating rollers 79 and 80 are, like the developing roller 81, rotatably supported by the development container 83 and is driven to rotate about an axis parallel to the axis of the developing roller 81. In this way, the developer supplied from the replenishing port 11 of the developing cartridge 1 to the development container 83 is further agitated before being supplied to the developing roller 81. The doctor blade 82 makes uniform the thickness of the developer which is risingly adsorbed on the circumferential surface of the developing roller 81 by the magnetic force exerted by the magnet included in the developing roller 81. The photoconductive body 71 is arranged opposite the developing roller 81 with a predetermined interval there between. The developer on the circumferential surface of the developing roller 81 is deposited on the photoconductive body 71, thereby visualizing the electrostatic latent image.

The transfer device 75, arranged opposite the photoconductive body 71, receives a reverse bias voltage to the developer so as for the image formed on the surface of the photoconductive body 71 to be transferred onto a recording paper sheet. The residual developer removing means 76 is shaped like a flat plate, and has its one end portion 85 brought into contact with the surface of the photoconductive body 71. The residual developer removing means 76 scrapes the transfer residual developer remaining on the surface of the photoconductive body 71 after the completion of image transfer process. In a case where the operation of the image forming apparatus 2 comes to a halt due to troubles such as jamming of recording paper sheets, during the time the image forming apparatus 2 returns to its normal state for resuming recording of images onto a recording paper sheet, the developer deposited on the photoconductive body 71 may possibly be removed and collected by the residual developer removing means 76 without undergoing transfer process be means of the transfer device 75. Such developer as removed from the surface of the photoconductive body 71 without undergoing transfer process is also defined as transfer residual developer.

The collecting means 77 includes: a helical member 86 for collecting and conveying the transfer residual developer removed by the residual developer removing means 76; a tubular duct member 87 for accommodating the helical member 86, through which the collected developer is conveyed; and a feeding port 89 for feeding the collected developer in a direction indicated by arrow 88 toward the collecting port 9.

In the image forming apparatus 2 of the embodiment, image formation and residual developer collection are achieved in the following manner. Developer is supplied from the first accommodating portion 3 of the developing cartridge 1 to the development container 83, and is there after fed to the developing roller 81 within the development container 83. The developer supplied to the developing roller 81 is fed through the surface of the developing roller 81 to the photoconductive body 71 carrying an electrostatic latent image, and is deposited on the surface thereof, whereby the image is visualized. The visualized image is transferred onto a recording paper sheet by the transfer device 75. The transfer residual developer remaining on the surface of the photoconductor body 71 after the completion of the image transfer process is removed by the residual developer removing means 76. The transfer residual developer removed by the residual developer removing means 76 is collected by the collecting means 77, and is then conveyed through the duct member 87 so as to be collected in the second accommodating portion 4 of the developing cartridge 1.

Since the image forming apparatus 2 includes the developing cartridge 1, it is possible to make the apparatus compact without the second accommodating portion 4 included in the developing cartridge 1 being increased in size more than necessary. Moreover, an amount of transfer residual developer to be conveyed from the second accommodating portion 4 to the first accommodating portion 3 is so set as to exceed the specified capacity of the second accommodating portion 4. Thus, even in a case where image formation is performed with use of developer mingled with transfer residual developer, degradation in the formed image quality can be prevented.

Figure 6:
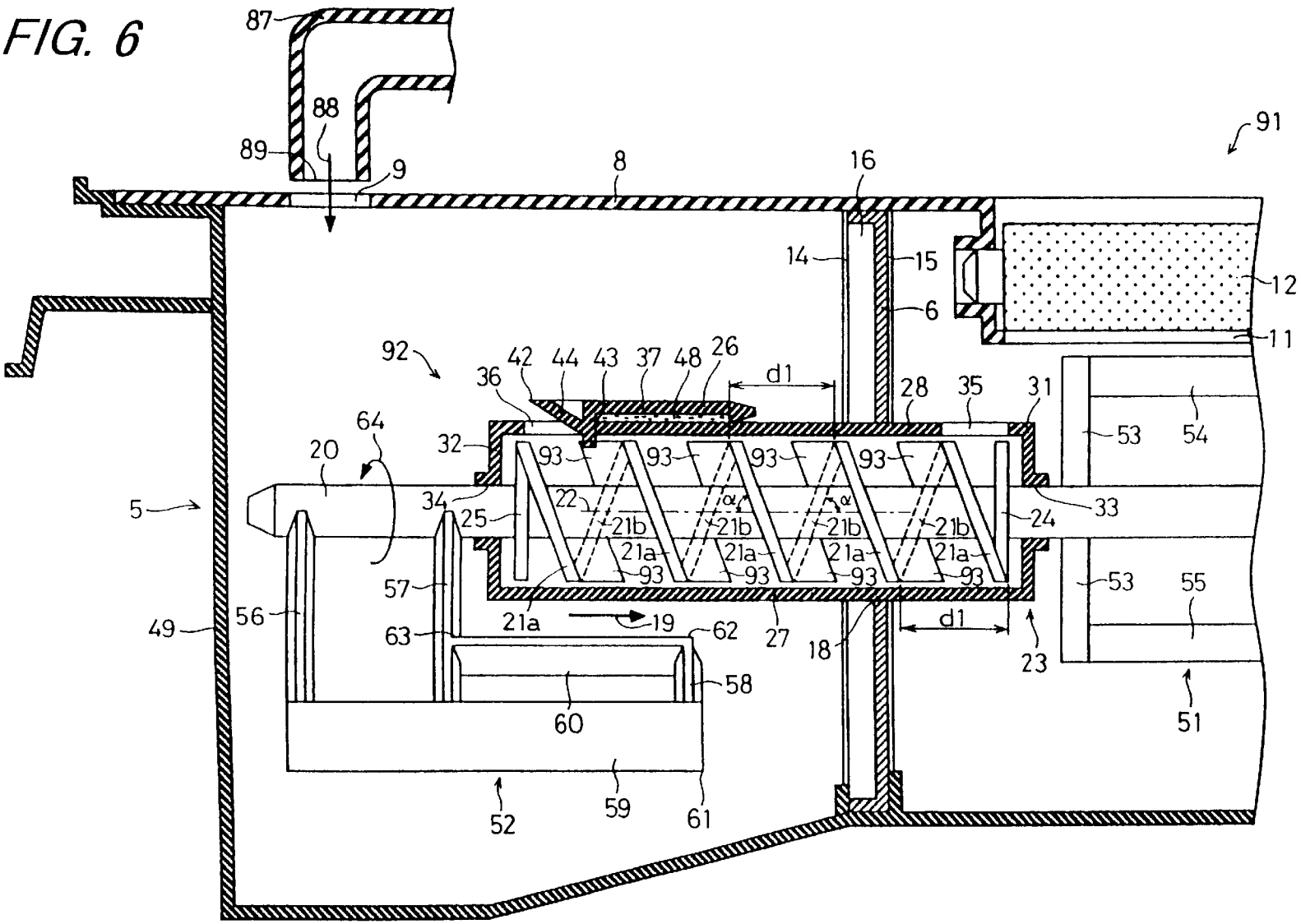
FIG. 6 is a schematic sectional view showing a simplified structure of a developing cartridge of a second embodiment according to the invention.
Figure 7:
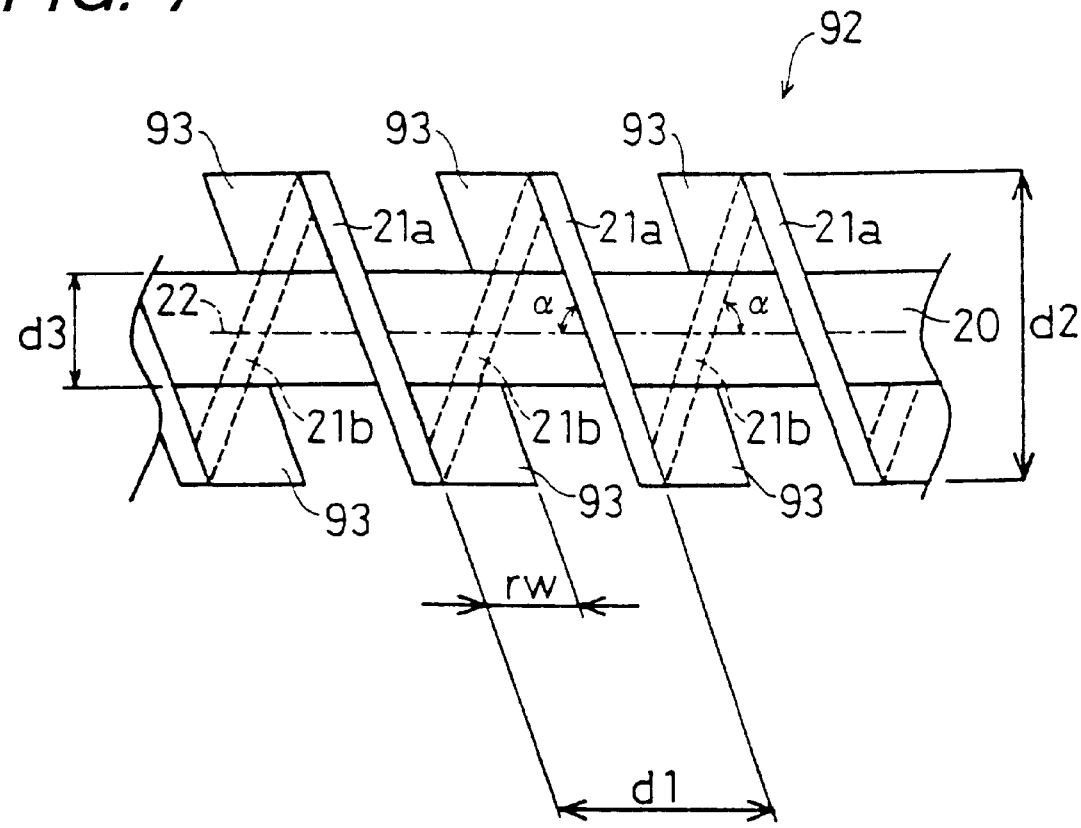
FIG. 7 is a partial enlarged view of a conveying member provided in the developing cartridge shown in FIG. 6.

FIG. 6 is a schematic sectional showing a simplified structure of a developing cartridge 91 of a second embodiment according to the invention, and FIG. 7 is a partial enlarged view of a conveying member 92 provided in the developing cartridge 91 shown in FIG. 6. The developing cartridge 91 of the second embodiment has basically the same structure as the developing cartridge 1 of the first embodiment. Hence, the components that play the same or corresponding roles as in the first embodiment will be identified with the same reference symbols, and overlapping descriptions will be omitted. It should be noted that the conveying member 92 is provided with a conveyance amount adjusting member 93 for adjusting an amount of developer to be conveyed.

In the image forming apparatus having the developing cartridge, one of major causes for reducing the transfer efficiency K to 85 percent or less is a recording paper jam as described previously. Transfer residual developer produced as a result of a recording paper jam is, without being transferred onto a recording paper sheet, removed from the surface of the photoconductor body 71 by the residual developer removing means 76 and is then collected, and intrusion of foreign substances such as paper fragments can be suppressed, thereby preventing degradation in image quality. As a result, even in a case where transfer residual developer produced as a result of a recording paper jam is conveyed from the second accommodating portion 4 to the first accommodating portion 3 by the conveying member 7 to be mingled with unused developer, the resultant developer can be used without causing any serious problem in image quality.

However, transfer residual developer includes not only one resulting from a recording paper jam, but also one containing foreign substances such as paper fragments as a result of transfer process. Thus, intrusion of a large amount of transfer residual developer into the unused developer stored in the first accommodating portion 3 is undesirable from the image quality standpoint. Particularly, in a state in which absolutely fresh developer yet to be used in development, which is stored in the first accommodating portion 3 in advance of the use of the developing cartridge, is small in quantity, when a large amount of transfer residual developer is conveyed to the first accommodating portion 3, the mixture ratio of the transfer residual developer to the absolutely fresh developer yet to be used in development increases. This may lead to troubles such as image defects, surface smudges, or toner scattering. To prevent occurrence of such problems, it is preferable to constructively control a conveyance amount of transfer residual developer to be conveyed from the second accommodating portion 4 to the first accommodating portion 3.

For example, a conveyance amount of transfer residual developer in the conveying member can be controlled by changing the configurations, arrangement intervals, and inclination angles $\alpha$ of the blade members 21*a* and 21*b*, or by employing, as the conveying member, a screw conveyer having a rotary helical blade in which the diameter and pitch of the helical blade is changed as necessary and the screw is composed of a plurality of strips. In either case, however, it is inevitable that the conveying member has a complicated configuration, and thus adjustment of a conveyance amount becomes difficult and a die used for fabricating the conveying member needs to have a complicated structure. To address problems involving conveyance amount control, in the developing cartridge 91 of the second embodiment, the conveyance amount adjusting member 93 is provided for the conveying member 92.

The conveyance amount adjusting member 93 is made of metal or hard synthetic resin and formed as a flat plate having a rectangular plane configuration. The conveyance amount adjusting member 93 is disposed on a virtual plane which includes the axis 22 of the conveying member 20 and separates the blade members 21*a* and 21*b* into two sections. Moreover, the conveyance amount adjusting member 93 is arranged adjacent to a radial portion of the semicircular blade member 21*a*, extends in the axis 22 direction, is disposed in a staggered arrangement via the blade member 21*a*, and is fitted to the conveying member 20.

Since the conveyance amount adjusting member 93 is shaped like a vertically-oriented rib, a length of the conveyance amount adjusting member 93 in the axis 22 direction is referred to as a rib width rw. By varying the rib width rw of the conveyance amount adjusting member 93, it is possible to control an amount of transfer residual developer to be conveyed from the second accommodating portion 4 to the first accommodating portion 3.

A relationship between the rib width rw of the conveyance amount adjusting member 93 and the conveyance amount will be described below. Assume that a diameter d2 of the blade member 21*a*, 21*b* projected in the axis 22 direction: 14 mm; an arrangement interval (pitch) d1 for the blade members 21*a* and 21*b:14* mm; a diameter d3 of the carrying shaft 20: 5 mm; and the number of revolutions of the carrying member 92: 6 rpm. Under this condition, the rib width rw is varied in four levels ranging from 4.5 to 14 mm, and the developer conveyance amount was measured. The result will be shown in Table 1 below.

TABLE 1

| Rib width rw (mm) | 4.5 | 5.0 | 5.5 | 14.0 |
|---|---|---|---|---|
| Developer conveyance amount (g/min) | 1.49 | 1.11 | 0.73 | 0 |

The larger the rib width rw of the conveyance amount adjusting member 93, the smaller the developer conveyance amount. That is, by adjusting the value of the ribwidth rw of the conveyance amount adjusting member 93 disposed in the conveying member 92, it is possible to control an amount of transfer residual developer to be conveyed from the second accommodating portion 4 to the first accommodating portion 3. By constructively controlling a conveyance amount of transfer residual developer with the use of the conveyance amount adjusting member 93 in the conveying member 92, it is possible to prevent an unduly large amount of transfer residual developer from being mingled with the unused developer stored in the first accommodating portion 3. As a result, even in a case where image development is performed with use of developer mingled with transfer residual developer, degradation in developed image quality can be successfully prevented.

Although, in this embodiment, a conveyance amount of transfer residual developer is controlled by varying the rib width rw of the conveyance amount adjusting member 93, it can also be controlled by varying the arrangement interval (pitch) d1 for the blade members 21*a* and 21*b*, the projected diameter d2 of the blade members 21*a* and 21*b* in the axis 22 direction, and the number of revolutions of the carrying member 92. In the latter case, as any of the arrangement interval d1, the projected diameter d2, and the number of revolutions is increased, the conveyance amount increases.

Note that there is no particular limitation to the following configurations associated with the first and second embodiments of the invention. Although the conveying member 7 is composed of the conveying shaft 20 and a plurality of blade members 21*a* and 21*b*, it may also be composed of a screw conveyer having a rotary helical blade formed in the conveying shaft 20. Moreover, although the first and second accommodating portions 3 and 4 have the first and second agitating members 51 and 52, respectively, they do not necessarily have to have said agitating member.

Although the conveying member 7 and the first and second agitating members 51 and 52 are formed integrally with one another, it is possible to adopt instead such a structure that the conveying member 7 is formed integrally only with the first agitating member 51 and the second agitating member 52 is separately provided, or such a structure that the conveying member 7 is formed integrally only with the second agitating member 52 and the first agitating member 51 is separately provided. Moreover, although the conveyance amount adjusting member 93 has a rectangular plane configuration, the plane configuration may be of triangular shape, semicircular shape, or any other shape. Further, although the conveyance amount adjusting member 93 is arranged adjacent to the blade member 21*a*, it may be arranged adjacent to the blade member 21*b*.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing cartridge comprising:

a housing including a first accommodating portion for accommodating developer yet to be used in development, and a second accommodating portion for accommodating developer having been used in development, the second accommodating portion being arranged adjacent to the first accommodating portion; and conveying means having a conveying member, for conveying, when an amount of developer to be stored in the second accommodating portion exceeds a predetermined level, the developer from the second accommodating portion to the first accommodating portion, the conveying means being so formed as to extend over the first and second accommodating portions.

2. The developing cartridge of claim 1, wherein the conveying member is provided with a conveyance amount adjusting member for adjusting a conveyance amount of developer.

3. The developing cartridge of claim 1, wherein the first accommodating portion is provided with an agitating member for agitating developer, and the conveying member is formed integrally with the agitating member.

4. The developing cartridge of claim 1, wherein the second accommodating portion is provided with an agitating member for agitating developer, and the conveying member is formed integrally with the agitating member.

5. The developing cartridge of claim 1, wherein the first accommodating portion is provided with a first agitating member for agitating developer, the second accommodating portion is provided with a second agitating member for agitating developer, and the conveying member is formed integrally with the first and second agitating members.

6. The developing cartridge of claim 1, wherein the conveying member includes:

a conveying shaft extending in a direction in which the conveying member conveys developer; and blade members provided in the conveying shaft, the blade members being separated into two sections with respect to a virtual plane including an axis of the conveying shaft, the blade members in one section and the blade members in another section being inclined at a same angle but inclined in mutually different directions, the blade members in the respective sections being spaced.

7. The developing cartridge of claim 6, wherein the conveying means further includes: a storage portion constituting a communication path which provides communication between the first and second accommodating portions, for accommodating the conveying member; and a shutter member disposed on an outer circumferential surface of the accommodating portion, and wherein, as the conveying shaft rotates about the axis, the blade member slides with the shutter member, and the shutter member is guided by the storage portion to move in a developer conveying direction.

8. The developing cartridge of claim 7, wherein, in the shutter member is formed a projection piece protruding toward an inner part of the storage portion, the projection piece retaining the blade member during the time the conveying shaft remains at rest before being rotated, and being disengaged from the blade member when the conveying member starts to rotate.

9. The development cartridge according to claim 1, wherein the conveying means is a physical structure that conveys the developer directly from the second accommodating portion to the first accommodating portion.

10. An image forming apparatus comprising:

a developing cartridge including: a housing including a first accommodating portion for accommodating developer yet to be used in development, and a second accommodating portion for accommodating developer having been used in development, the second accommodating portion being arranged adjacent to the first accommodating portion; and conveying means having a conveying member, for conveying, when an amount of developer to be stored in the second accommodating portion exceeds a predetermined level, the developer from the second accommodating portion to the first accommodating portion, the conveying means being so formed as to extend over the first and second accommodating portions;

a photoconductive body for carrying an electrostatic latent image;

developing means for visualizing the electrostatic latent image carried on the photoconductive body with use of developer supplied from the developing cartridge;

transfer means for transferring developer deposited on the photoconductive body onto a recording paper sheet;

residual developer removing means for removing developer remaining on the photoconductor body after image transfer process; and collecting means for collecting developer removed by the residual developer removing means.

11. The image forming apparatus of claim 10, wherein the conveying member is provided with a conveyance amount adjusting member for adjusting a conveyance amount of developer.

12. The image forming apparatus of claim 10, wherein the first accommodating portion is provided with an agitating member for agitating developer, and the conveying member is formed integrally with the agitating member.

13. The image forming apparatus of claim 10, wherein the second accommodating portion is provided with an agitating member for agitating developer, and the conveying member is formed integrally with the agitating member.

14. The image forming apparatus of claim 10, wherein the first accommodating portion is provided with a first agitating member for agitating developer, the second accommodating portion is provided with a second agitating member for agitating developer, and the conveying member is formed integrally with the first and second agitating members.

15. The image forming apparatus of claim 10, wherein the conveying member includes:

a conveying shaft extending in a direction in which the conveying member conveys developer; and blade members provided in the conveying shaft, the blade members being separated into two sections with respect to a virtual plane including an axis of the conveying shaft, the blade members in one section and the blade members in another section being inclined at a same angle but inclined in mutually different directions, the blade members in the respective sections being spaced.

16. The image forming apparatus of claim 15, wherein the conveying means further includes: a storage portion constituting a communication path which provides communication between the first and second accommodating portions for storing the conveying member; and a shutter member disposed on an outer circumferential surface of the storage portion, and wherein, as the conveying shaft rotates about the axis, the blade member slides with the shutter member, and the shutter member is guided by the storage portion to move in a developer conveying direction.

17. The image forming apparatus of claim 16, wherein, in the shutter member is formed a projection piece protruding toward an inner part of the storage portion, the projection piece retaining the blade member during the time the conveying shaft remains at rest before being rotated, and being disengaged from the blade member when the conveying member starts to rotate.

18. The image forming apparatus according to claim 10 wherein the conveying means is a physical structure that conveys the developer directly from the second accommodating portion to the first accommodating portion.

* * * * *